US005454522A

United States Patent [19]

Ballu

[11] Patent Number: 5,454,522

[45] Date of Patent: Oct. 3, 1995

[54] APPARATUS FOR BREAKING SOLID OBJECTS

[75] Inventor: Patrick J. Ballu, Reims, France

[73] Assignee: Tecnoma, Epernay, France

[21] Appl. No.: 223,046

[22] Filed: Apr. 5, 1994

[30] Foreign Application Priority Data

Apr. 16, 1993 [FR] France ..... 93 04526

[51] Int. Cl.[6] ..... B02C 18/16

[52] U.S. Cl. ..... 241/237; 241/239; 241/243; 241/DIG. 30

[58] Field of Search ..... 241/237, 239, 241/240, 241, 242, 243, 264, DIG. 30

[56] References Cited

U.S. PATENT DOCUMENTS

| | | | |
|---|---|---|---|
| 1,524,675 | 2/1925 | Smith | 241/240 |
| 3,005,637 | 10/1961 | Hetteen | 241/240 |
| 3,952,957 | 4/1976 | Maillet | 241/241 X |
| 4,017,035 | 4/1977 | Stuttman | 241/241 X |
| 4,077,573 | 3/1978 | Kersey et al. | 241/243 X |
| 4,801,101 | 1/1989 | Dreyer et al. | 241/240 |
| 4,972,999 | 11/1990 | Grace | 241/243 X |

FOREIGN PATENT DOCUMENTS

| | | |
|---|---|---|
| 2127685 | 2/1972 | France . |
| 2254371 | 12/1973 | France . |

*Primary Examiner*—Timothy V. Eley
*Attorney, Agent, or Firm*—Watson, Cole, Grindle & Watson

[57] ABSTRACT

An apparatus for breaking solid objects includes a box-shaped support (6) open at the top and at the bottom, a substantially horizontal rotor (6) mounted in the box and carrying at least one knife which turns with it while passing between backing knives, an active face of which is turned toward the rotor, and preferably has teeth, the backing knives being movable independently of each other and having their own return means, for example by oscillating the backing knives on a pivot parallel to the rotor. The knives may be set in forced oscillation, and may be individually removable.

15 Claims, 2 Drawing Sheets

APPARATUS FOR BREAKING SOLID OBJECTS

BACKGROUND OF THE INVENTION

The present invention relates to an apparatus for breaking solid objects, and in particular industrial and domestic waste, with a view to recycling.

Among the many breaking apparatuses in use, the one described in French Patent 2,254,271 is noteworthy for its properties of adapting to objects of various types, which are both fragile and flexible. This apparatus comprises a support hopper with an entry opening in the top and an exit opening in the bottom, a rotor, having a of horizontal axis and carrying two radial knives, and a set of backing knives, integral with the support hopper, between which the knives pass during the rotation of the rotor. These backing knives are grouped in a comb and a backing comb, an object moved by the rotor in its rotation successively encountering the comb and then the backing comb.

The active surface of the backing knives of the comb is straight and toothed, that is to say that it has notches which constitute stops which arrest the movement of an object to be broken.

In practical embodiments in accordance with this patent, the axial gap between a knife of the rotor and the adjacent backing knives of the comb is relatively large, for example 5 to 10 mm, and this part of the apparatus acts as a grinder, while the axial gap between a knife of the rotor and the adjacent backing knives of the backing comb is much smaller, for example 0.5 to 1 mm, so that this part operates as a cutter, whence the name "grinder/cutter" frequently given to this type of apparatus.

The apparatus operates at relatively low rotational speeds of the rotor, for example of the order of 20 r.p.m., so that it is not very noisy. When there is an object which is too strong to be ground, rotation in the opposite direction through approximately one revolution makes it possible to remove it through an auxiliary orifice situated beyond the backing comb, in the normal rotation direction.

French Patent 2,127,685 describes a fairly similar apparatus, except that the backing knives are mounted on a common "anvil", which can pivot with respect to the support hopper about an axis parallel to that of the rotor. This arrangement has the advantage that, when there is an excessively strong object, the anvil, with the backing knives, moves away from the rotor to let this object pass. A return jack then returns the anvil to the normal position. This system is combined with a smooth shape, curved toward the rotor, of the active face of the backing knives, intended to facilitate removal of ungrindable objects, but reduces the efficiency of the apparatus for breaking other objects.

U.S. Pat. No. 4,917,310, which corresponds to the preamble of claim 1, describes an apparatus which differs from that of French 127,685 in that the backing knives are straight, and especially in that the backing knives are movable independently of each other, and provided with return means which may consist of fluidic jacks connected to a pneumatic accumulator. This device provides some improvement in efficiency, but this is outweighed by an increase in its complexity.

Soviet Union Patent 697,186 describes a device for breaking up blocks of reinforced concrete, in which these blocks, sliding over a planar support, are struck by a tool driven in a reciprocating vertical movement using an eccentric device.

It seems that the concrete is disintegrated by the repeated impacts, and releases the reinforcement irons. Nothing suggests that these reciprocating movements can be effective in a device operating by cutting for breaking solid objects which may exhibit some degree of flexibility, such as waste, and in preventing clogging.

SUMMARY OF THE INVENTION

The present invention originates from research for improving the existing equipment as regards its efficiency, reduction of the time lost in the presence of an object which is difficult to grind, as well as decreasing the risks of clogging and improving the maintenance cost.

It was unexpectedly observed that significant improvements could be obtained if the backing knives were set in forced vibration individually.

The invention consequently provides an apparatus for breaking solid objects, comprising:

a box-shaped support, with at least one entry opening at the top and one exit opening at the bottom, this support defining a vertical passage, a rotor mounted in the support so as to be able to turn on a substantially horizontal axis without being able to move along this axis, this rotor carrying at least one knife which moves away from the axis, at least two backing knives projecting in the direction of the axis of the rotor, the knife of the rotor passing between the backing knives during its rotation, each of the backing knives having an active surface turned toward the rotor and being movable on the support independently of the others, so that its active surface can be moved away from the rotor, return means being provided for returning said active surfaces into a normal position, fixed in advance, the return means of one backing knife being independent of those of the other backing knives, this apparatus comprising means for setting the backing knives in forced oscillation.

According to an advantageous embodiment, when the return means is a fluidic jack, the apparatus is equipped with means for vibrating the fluid contained in the fluidic jack, this jack then constituting both a return means and a vibration means for the backing knife.

According to other advantageous alternatives:

means for adjusting the amplitude of the oscillations are provided, the amplitude of the oscillations is limited by an elastomer mass or one or more springs, the backing knives are mounted to pivot on a shaft parallel to the axis of the rotor, this pivot shaft is placed at a small distance from the center of gravity of each backing knife, while being outside the volume swept by the knives of the rotor, the backing knives are mounted to pivot on a shaft parallel to the axis of the rotor, so that, at rest, a plane passing through the axes of said shaft and of the rotor passes approximately through the middle of the active surface of each rotor.

It has moreover been established that the structure of the invention lends itself to obtaining structures which are easy to remove, the cost of use of which may be reduced.

According to the preferred embodiments indicated hereinabove, a backing knife is carried by a pivot mounted in a fixed position with respect to the support and parallel to the axis of the rotor. Other embodiments may, however, be envisaged. For example, the backing knives may be guided on straight or curved slideways, or alternatively on return means, especially formed by springs or elastomer blocks, which might themselves constitute the guide means.

As return means, in addition to the metal springs or elastomer blocks which have just been mentioned, fluidic jacks may also be provided. These can be simplified, for example consisting of a projection integral with the backing knife and penetrating into a suitable cavity of the support.

Advantageously, the normal position, fixed in advance, of a backing knife is defined by a stop against which the backing knife is pushed by the return means.

It will be noted that, if the apparatus includes several rotors, the backing knives may be common to these rotors, with an active face turned toward each of them.

Advantageously, the active surface of the backing knife has a plurality of teeth capable of holding an object being broken, to facilitate its cutting by a knife of the rotor passing between two adjacent backing knives.

This feature was described in French 2,254,371. In an apparatus according to the invention, its efficiency is substantially improved by virtue of the mobility of the knives.

Advantageously, this feature is here combined with a shape of the active surface of the backing knife such that the apices of the teeth are situated on a curve whose concavity is turned toward the axis of the rotor.

The exact optimal shape of the active surface of a backing knife should be determined experimentally. It will be clear, even to nonspecialists, that this shape: size and orientation of the teeth, curvature of the whole of the surface, etc. has little chance of being the same for breaking pieces of flexible plastic reinforced with fibers or glass bottles, for example.

Provision may also be made for the knife or knives of the rotor to have an active surface including teeth.

A description will now be given of two particular embodiments of the invention which have the effect of reducing the costs of using the apparatus.

It has been observed, when using apparatuses according to the prior art, that the backing knives situated in the central region become worn faster than the others. When they have reached a degree of wear such that their efficiency is reduced, the whole of the support box must be changed.

The invention provides an appreciable gain if provision is made for the knife holders to be mounted separately from each other and removably, while being fitted onto a common holding piece consisting of a bar parallel to the axis of the rotor and, advantageously, for the knife holders to be mounted separately from each other and removably, while being fitted onto a common holding piece consisting of a bar parallel to the axis of the shaft.

It is thus possible to replace only the backing knives which are worn or damaged, or interchange them with those of the less worn side areas, etc. .

Advantageously, with a similar object, several knives are provided fitted onto the rotor separately from each other, without possible rotation with respect to the rotor, and advantageously mutually interchangeable.

BRIEF DESCRIPTION OF THE DRAWINGS

The invention will now be described in more detail using a practical example, illustrated with the aid of the drawings, among which.

DETAILED DESCRIPTION OF THE INVENTION

Figure 1:
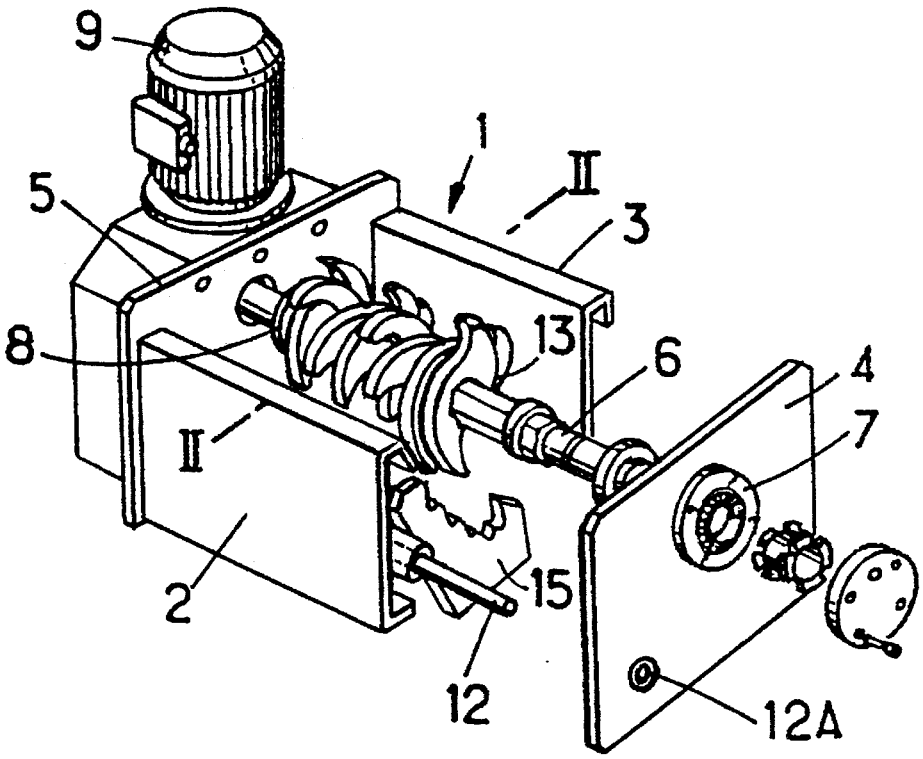
FIG. 1 is a simplified overall view, in exploded perspective, of the crusher.

The apparatus described by way of example comprises a support 1, comprising of two side panels 2, 3, which are generally vertical, connected together by two small vertical end plates 4, 5. The assembly thus defines a vertical passage, of rectangular general shape. A horizontal rotor shaft 6, mounted in rotation on bearings 7, 8, which are carried by the end plates 4, 5, extends inside this passage. One of the end plates 5 also carries a motor 9 for driving the rotor.

One of the side panels 3 has a vertical surface facing the rotor, while the other panel 2 includes an inclined upper part 10, which gives a hopper shape to the internal passage of the support.

A pivot 12, parallel to the axis of the rotor 6, is mounted in holes provided in the end plates 4, 5. Only one of these holes, 12A, is shown in FIG. 1. The pivot 12 can slide through these holes, with a view to removal. It is situated toward the lower part of the side panel 2, below the inclined part 10, without projecting into the internal passage of the support. Provision may be made for the pivot 12 to be blocked in rotation on its axis, or to be able to pivot on itself.

The rotor 6 carries a series of knives 13, which are made as a thick plate, cut into a general S-shape, with two active faces whose concavity is turned toward the front in the direction of rotation symbolically represented by the arrow 14. The end of each active face constitutes a tooth pointing forward.

Figure 4:
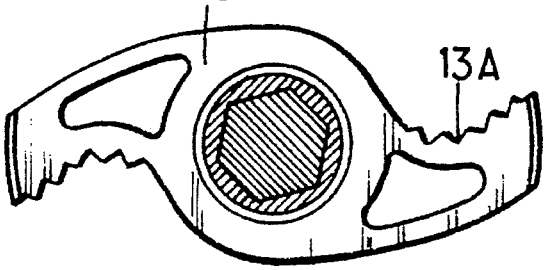
FIG. 4 is a detailed view illustrating a variant of the rotor.

FIG. 4 shows a variant in which the active face of the rotor 13 has a plurality of teeth 13A.

Figure 2:
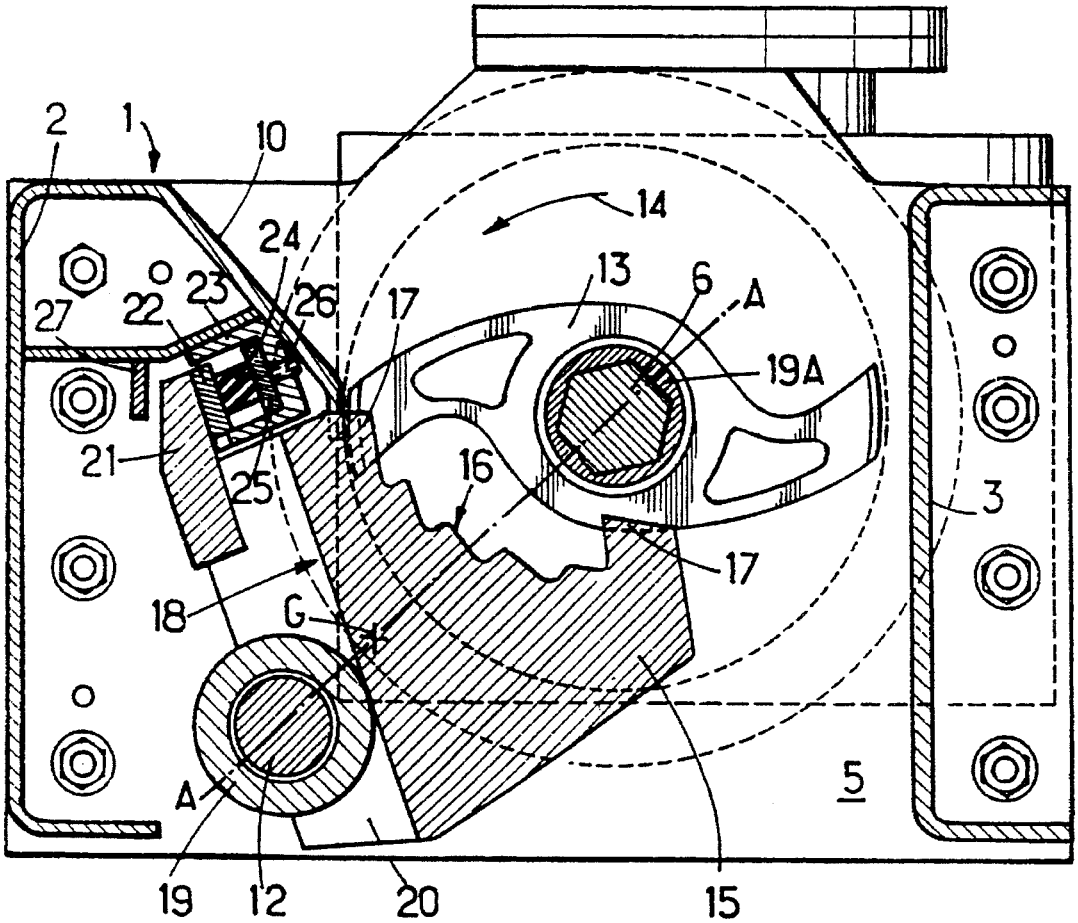
FIG. 2 is a section along the line II—II in FIG. 1.

The knives are mounted on the rotor, which passes through them in their central part, without possible rotation relative to the rotor. For this purpose, as represented in FIG. 2, the rotor has a hexagonal cross section, as does the central bore of the knife. This allows the use of identical knives, offset with respect to one another by one sixth of a turn. Clearly, a shape, for example splined, may be given to the rotor, and a corresponding shape to the bore of the knives.

The backing knives 15 are interposed between the knives 13. Each backing knife 15 comprises mainly of a plate of triangular general shape. It will be observed that, in the example described, the knives and the backing knives comprise plates with edges parallel and perpendicular to the axis of the rotor. This arrangement, which makes them easier to obtain, is not essential, and it is contemplated, for example, for the knives to decrease in thickness when moving away from the axis of the rotor, or vice versa, and for the backing knives to have a cross section designed to keep the axial gap between a knife and the adjacent backing knife constant.

The active face 16 of the backing knife has a concavity which is turned upward and toward the axis of the rotor. It includes teeth 17, the shape of which is not given precisely, because it depends closely on the nature of the objects to be processed. It will, however, be observed that these teeth advantageously have a side turned away from the direction of rotation 14 of the rotor, and which makes, with the direction of the objects which will strike it, an angle close to 90°, while the opposite side of each tooth is, conversely, close to a parallel to the path of the objects moved by the knives 13. A second side 18 of each triangular plate constituting a backing knife 15 carries a sleeve 19 pointing parallel to the axis of the rotor, and which is passed through by the fixed pivot 12, while allowing pivoting of the backing knife about this shaft. The linkage between the sleeve 19 and the backing knife 15 is provided by two braced plates 20, parallel to the plate 15, solidly attached thereto and offset with respect thereto in the axial direction.

At rest, the backing knife extends from the vicinity of the lower edge of the inclined part 10 of the side panel 2 to the vicinity of the rotor 6. It moves slightly away from the latter under the thrust of an object to be broken.

The thickness of the plates 20, and/or the length of the sleeves 19 are calculated to ensure the desired separation between two adjacent backing knives.

This separation is equal to the thickness of a knife 13 plus twice the intended axial clearance between a knife and the adjacent backing knife. It will be noted that bracing sleeves 19A are provided, in a similar manner, between the knives 13, in order to establish between them a spacing equal to the thickness of a backing knife plus twice the value of the intended axial clearance.

The thickness of the knives and the backing knives, as well as the axial clearances, and therefore the separation between the successive knives and backing knives can be adapted as a function of the nature of the material of the objects to be ground, as well as the shape, the dimensions and the particle size, both of these objects and of the products which it is desired to obtain.

The plates 20 also carry an arm 21, which extends upward parallel to the side 18, the extension of which passes substantially through the axis of the pivot 12. The arm 21 carries a stop 22, perpendicular to the arm 21, and the axis of which is in the plane of the backing knife 15. This stop 22 penetrates into a closed-bottomed collar 23, which is fixed onto the inclined part 10 of the side panel 2. An elastomer mass 24 is interposed between the stop 22 and a bearing plate 25 situated in the vicinity of the bottom of the collar 23. A set screw 26 makes it possible to separate the bearing plate 25 from the bottom of the collar to a greater or lesser extent.

In a variant, the set screw 26 is mounted in the arm 21, to act on the stop 22. This arrangement allows easier access to the screw 21. Furthermore, the bearing plate 25 may then be eliminated, the elastomer mass 22 then bearing against the bottom of the collar 23.

It is seen that a force exerted on the backing knife and resulting from the thrust of an object moved in the direction of the arrow 14 by a knife 13 tends to pivot the backing knife about the pivot 12, and consequently to crush the elastomer mass 24. The latter then develops a return torque, and the successive impacts of the objects to be processed on the backing knife set the latter in a state of vibrational oscillations which is then damped.

By actuating the set screw 26, it is possible to vary the amplitude of the oscillations. The frequency thereof can be modified, at equal amplitude, by changing the elastomer mass 24.

A stop 27 limits the amplitude of the pivoting in the opposite direction of the backing knife, it prevents the latter from coming into contact with the rotor and defines its normal position.

It will be noted that it is possible to replace the elastomer mass 24 by one or more springs, for example a stack of Belleville washers.

Figure 3:
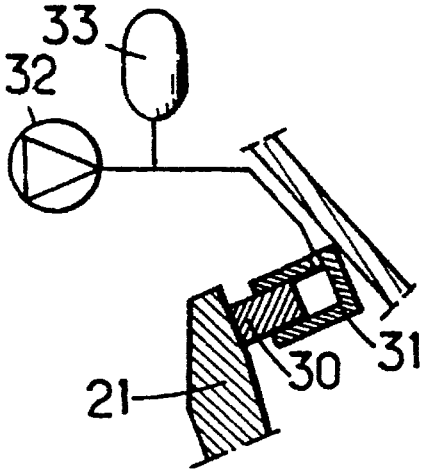
FIG. 3 is a detailed view illustrating a variant of the embodiment in FIG. 2.

According to a variant illustrated in FIG. 3, the arm 21 carries a projection 30, forming a piston, which penetrates into a cylinder 31, connected to a vibrational source 32 of pressurized fluid, such as oil, and to a gas pressure accumulator 33. The fluid keeps the backing knife in the state of forced oscillations, while, when an object to be broken pivots the backing knife on the pivot 12, the presence of the accumulator 33 makes the cylinder 31 act as an elastic return member.

An individual accumulator is provided for each backing knife, so that each of them is subjected to an individual oscillatory regime. It will be observed, on this subject, that U.S. Pat. No. 4,917,310 provides no specific accumulator for each backing knife.

In the arrangement represented, the return means 20 to 26, 30, 31 are in front of the pivot 12, in the direction of rotation of the rotor 13, indicated by the arrow 14. A person skilled in the art will understand that other arrangements are possible. It is sufficient for the return means to be arranged so as to oppose pivoting of the backing knife resulting from the passage of an object to be ground.

However, the arrangement represented has the following advantageous features:

1 the center of gravity G of the knife holder 15 is at the smallest possible distance from the pivot 12, considering the fact that this pivot must be outside the volume swept by the knives 13 of the rotor.

the plane containing the axes of the pivot 12 and of the rotor 6, which is symbolically represented by the line A—A in FIG. 2, passes approximately through the middle of the active surface 16 of the backing knife.

These two features combine to produce a very solid assembly, of equal weight, with a smaller inertia in the case of forced oscillation being imposed, and by virtue of which the moments of the torques created by friction and impacts caused by the objects to be broken are best balanced.

If it is desired to replace a backing knife with another one, it is sufficient to slide the pivot 12 through the hole 12A of the plate 4, for example by introducing a temporary holding rod into the corresponding hole in the plate 5. When the end of the pivot 12 has just passed the backing knife which it is desired to replace, it is sufficient to move the temporary holding rod back by a length corresponding to the length of the sleeve 19 or to the distance between the outer faces of the plates 20. The backing knife is then freed and can be replaced. Clearly, it is also possible to slide the pivot 12 through the hole in the plate 5.

It has been observed that, with the apparatus which has just been described, when an object cannot be broken, if the rotor is turned in the opposite direction approximately through only a quarter turn, before resuming the normal rotation, correct breaking is very frequently obtained. This is attributed to the fact that, because of the vibration of the backing knives, the object which is difficult to grind comes, after this maneuver, into contact with a backing knife in a different arrangement, which is sufficient to obtain good cutting. This thus avoids rejection of the unground object by a larger rotation in the opposite direction, as is done in the prior art. This therefore simultaneously avoids loss of time and rejection of unusable unground products.

Experience has shown that, compared with a conventional crusher of the type described in French 2,254,371, the hourly throughput, with an apparatus of the type described here, is multiplied by 2 to 3. In addition, the particle sizes obtained are much more homogeneous, which facilitates the recycling, or indeed makes it possible in the case where an excessively high dispersion of the sizes might make it economically unacceptable with the apparatuses of the prior art.

I claim:

1. An apparatus for breaking solid objects, comprising:

a box-shaped support, with at least one entry opening at the top and one exit opening at the bottom, the support defining a vertical passage, a rotor mounted in the support for rotation about a substantially horizontal axis without movement along said axis, the rotor carrying at least one knife extending radially from the axis, at least two backing knives projecting in the direction of the axis of the rotor, the knife of the rotor passing between the backing knives during its rotation, each of the backing knifes having an active surface turned toward the rotor and being movable on the support independently of the others, so that its active surface can be moved away from the rotor, return means being provided for returning said active surfaces into a normal position, fixed in advance, the return means of one backing knife being independent of those of the other backing knifes, and means for setting the backing knives in forced oscillation.

2. The apparatus as claimed in claim 1, wherein the return means of a backing knife comprise a fluidic jack, said apparatus being furthermore equipped with means for vibrating the fluid contained in the fluidic jack, said jack constituting both a return means and a vibration means for the backing knife.

3. The apparatus as claimed in claim 1, additionally comprising means for adjusting the amplitude of the oscillations.

4. The apparatus as claimed in claim 3, wherein the amplitude of the oscillations is limited by a means chosen from an elastomer mass and at least one spring.

5. The apparatus as claimed in claim 1, wherein the backing knives are mounted to pivot on a shaft parallel to the axis of the rotor, said shaft being located a small distance from the center of gravity of each backing knife, while being outside the volume swept by the knives of the rotor.

6. The apparatus as claimed in claim 1, wherein the backing knives are mounted to pivot on a shaft parallel to the axis of the rotor, and wherein, at rest, a plane passing through the axes of said shaft and of the rotor passes approximately through the middle of the active surface of each rotor.

7. The apparatus as claimed in claim 1, wherein the active face of the backing knife has a plurality of teeth capable of holding an object being broken.

8. The apparatus as claimed in claim 7, wherein the teeth have apices which are situated on a curve whose concavity is turned toward the axis of the rotor.

9. The apparatus as claimed in claim 7, wherein the teeth of the backing knife have a side turned away from the direction of rotation of the rotor, and which makes, with the direction of the objects which have just struck it, an angle close to 90°, while the opposite side of each tooth is conversely close to a parallel to the path of the objects moved by the knives.

10. The apparatus as claimed in claim 1, wherein the knife or knives of the rotor have an active surface including a plurality of teeth.

11. The apparatus as claimed in claim 1, wherein the backing knives are mounted separately from each other and removably, while being fitted onto a common holding piece comprising a bar parallel to the axis of the rotor.

12. The apparatus as claimed in claim 11, wherein the backing knives are mutually interchangeable.

13. The apparatus as claimed in claim 11, wherein the bar is mounted in holes in the walls of the support, and can slide axially in these holes for removal of the backing knives.

14. The apparatus as claimed in claim 1, wherein the knives are mounted separately from each other and removably, while being fitted onto the rotor, without possible rotation, relative to the rotor.

15. The apparatus as claimed in claim 14, wherein the knives are mutually interchangeable.

* * * * *